US011083923B2

(12) United States Patent
Potapov

(10) Patent No.: US 11,083,923 B2
(45) Date of Patent: Aug. 10, 2021

(54) EXERCISE PLATFORM AND ACCESSORIES SYSTEM

(71) Applicant: Roman Potapov, Durham, NC (US)

(72) Inventor: Roman Potapov, Durham, NC (US)

( * ) Notice: Subject to any disclaimer, the term of this patent is extended or adjusted under 35 U.S.C. 154(b) by 0 days.

(21) Appl. No.: 17/078,044

(22) Filed: Oct. 22, 2020

(65) Prior Publication Data

US 2021/0121726 A1 Apr. 29, 2021

Related U.S. Application Data

(60) Provisional application No. 62/925,213, filed on Oct. 23, 2019.

(51) Int. Cl.
*A63B 21/00* (2006.01)
*A63B 21/16* (2006.01)

(52) U.S. Cl.
CPC .... *A63B 21/00061* (2013.01); *A63B 21/1672* (2015.10); *A63B 21/4033* (2015.10); *A63B 21/4037* (2015.10); *A63B 2225/09* (2013.01)

(58) Field of Classification Search
CPC ..... A63B 21/00047; A63B 21/00058; A63B 21/00061; A63B 21/00065; A63B 21/00178; A63B 21/00185; A63B 21/002; A63B 21/0023; A63B 21/068; A63B 21/15; A63B 21/159; A63B 21/16; A63B 21/1672; A63B 21/4023; A63B 21/4027; A63B 21/4033; A63B 21/4034; A63B 21/4035; A63B 21/4037; A63B 21/4039; A63B 21/4047; A63B 21/4049; A63B 22/0046; A63B 22/0048; A63B 2023/006; A63B 69/0057; A63B 69/0062; A63B 2225/09; A63B 2225/093
See application file for complete search history.

(56) References Cited

U.S. PATENT DOCUMENTS 4,492,376 A * 1/1985 Schatz ..... A63B 23/00 482/129
5,087,036 A * 2/1992 Cooper ..... A63B 23/085 482/79
5,100,130 A * 3/1992 Shoebrooks ..... A63B 21/4037 482/121
5,125,883 A * 6/1992 Shoebrooks ..... A63B 21/4039 482/140
5,417,636 A 5/1995 Havens
5,451,194 A * 9/1995 Harrigan ..... A63B 21/0552 482/124

(Continued)

*Primary Examiner* — Gary D Urbiel Goldner
(74) *Attorney, Agent, or Firm* — Houda El-Jarrah; Bold IP, PLLC

(57) ABSTRACT

An exercise platform and accessories system is provided. The exercise platform is configured with a plurality of attachment mechanisms adapted to connect one or more hardware accessories to the platform. The attachment mechanisms include rotatable pivot pegs that may be rotated upright into a generally vertical position for use and rotated downward into a generally horizontal position for storage. Hardware accessories that may be attached to the attachment mechanisms may include pegs, exercise bands, upward limiters, horizontal low pads, high rolls, inclined pads, vertical pads, low rolls, and tall grips. The system provides a fully configurable system for isolating and relaxing specific musculoskeletal groups during use.

13 Claims, 14 Drawing Sheets

(56) References Cited

U.S. PATENT DOCUMENTS 5,529,562 A * 6/1996 Glaser ..... A63B 21/154 482/123
D391,314 S * 2/1998 Cordero ..... D21/687
5,980,433 A * 11/1999 Ramsay ..... A63B 23/085 482/80
6,312,345 B1 * 11/2001 Pelz ..... A63B 69/3661 473/278
6,872,175 B2 * 3/2005 Lin ..... A63B 21/0004 482/121
7,410,450 B1 * 8/2008 Paulding ..... A63B 21/0552 482/120
7,431,681 B1 * 10/2008 St. Cyr ..... A63B 21/0552 482/121
7,591,763 B1 * 9/2009 Fucci ..... A63B 21/0552 482/121
8,911,300 B1 * 12/2014 Alvarado ..... A63B 69/3661 473/278
8,992,389 B2 * 3/2015 Abel ..... A63B 23/03541 482/51
9,211,437 B2 12/2015 Soba
9,364,382 B1 * 6/2016 Cooper ..... A61H 1/0266
9,504,871 B2 * 11/2016 Munoz Saez ..... A63B 21/16
9,586,121 B1 * 3/2017 Carlson ..... A63B 69/3661
9,737,748 B1 * 8/2017 Chapman ..... A63B 17/04
9,789,346 B1 * 10/2017 Kime ..... A63B 23/0233
9,931,530 B2 * 4/2018 Bonner ..... B63B 32/70
10,315,065 B1 * 6/2019 Soba ..... A63B 21/151
10,357,677 B2 * 7/2019 Austin ..... A63B 21/0442
10,617,217 B1 * 4/2020 Razon ..... A47C 3/40
10,702,740 B2 * 7/2020 Tarkington ..... A63B 21/0407
2002/0160891 A1 * 10/2002 Gallagher ..... A63B 21/154 482/123
2004/0152532 A1 * 8/2004 Simpson ..... A63B 69/3623 473/235
2005/0148449 A1 * 7/2005 Weir ..... A63B 21/078 482/142
2008/0070753 A1 * 3/2008 Suida ..... A63B 21/00047 482/33
2010/0299833 A1 12/2010 Kessler
2011/0251033 A1 * 10/2011 Blancher ..... A63B 22/16 482/123
2011/0319230 A1 * 12/2011 Brendle ..... A63B 69/0048 482/37
2013/0196835 A1 * 8/2013 Solow ..... A63B 21/023 482/142
2013/0324382 A1 12/2013 Wilson
2014/0031175 A1 * 1/2014 Peralo ..... A63B 23/0244 482/66
2014/0162853 A1 * 6/2014 Kadar ..... A63B 21/026 482/130
2015/0141219 A1 * 5/2015 Bellevue ..... A63B 21/00047 482/130
2016/0016029 A1 * 1/2016 Savioli ..... A63B 21/4037 482/92
2016/0067540 A1 3/2016 Dill
2017/0128775 A1 * 5/2017 Santos ..... A63B 21/00069
2018/0345064 A1 * 12/2018 Aronson ..... A63B 21/025
2019/0262210 A1 * 8/2019 Rideout ..... A61H 1/0266
2019/0262658 A1 * 8/2019 Salamone ..... A63B 21/4037
2019/0308072 A1 * 10/2019 Metcalfe ..... A63B 26/003
2019/0329111 A1 * 10/2019 Moran ..... A63B 69/004
2020/0086170 A1 * 3/2020 Tarkington ..... A63B 21/0557
2020/0154877 A1 * 5/2020 Hurley ..... A47B 3/10
2020/0179745 A1 * 6/2020 Randleman ..... A63B 21/05
2020/0269079 A1 * 8/2020 Jaquish ..... A61H 1/00

* cited by examiner

EXERCISE PLATFORM AND ACCESSORIES SYSTEM

CROSS REFERENCE TO RELATED APPLICATION

This application is a non-provisional application which claims priority to U.S. Provisional Application No. 62/925,213 filed on Oct. 23, 2019 which is incorporated by reference in its entirety.

FIELD OF THE INVENTION

This invention relates to exercise equipment, including an exercise platform with attachable exercise accessories.

BACKGROUND

According to the International Health, Racquet & Sportsclub Association (IHRSA), the U.S. health and fitness industry is a $30 billion market growing at a rate of 3-4% annually.

As is known, there is a wide variety of different types of exercise equipment available for home and/or gym use. When using the equipment, it is often important to properly isolate particular muscles (and/or muscle groups) or other parts of the body for maximum exercise, relaxation and/or stretching effect.

However, there are many downfalls with the current equipment used for these purposes. For example, upright standing stretching machines fail to provide complete isolation and/or relaxation of the targeted body parts while in use. In addition, these machines are quite expensive. In another example, mechanical leg-muscle stretching machines provide a very limited range of use, are overly complex, and are large and heavy. In another example, self-pull straps also only provide a narrow range of use and do not achieve complete isolation and/or relaxation of the targeted body parts.

Accordingly, there is a need for an exercise assembly that provides for simultaneous isolation and relaxation of the engaged musculoskeletal groups when in use. There also is a need for an assembly that provides these benefits with a wide range of use without unnecessarily complicated parts.

SUMMARY

According to one aspect, one or more embodiments are provided below for an exercise assembly. The exercise assembly may include a platform including a first layer and a second layer, a lower surface of the first layer defining a bottom of the platform and an upper surface of the second layer defining a top of the platform, a first opening passing through the second layer and exposing a first exposed portion of the first layer, a first attachment mechanism comprising a first attachment first portion configured with the first layer in an area of the first exposed portion, and a first attachment second portion adapted to be removably attached to the first attachment first portion, and a first accessory configured with the first attachment second portion of the first attachment mechanism. The first accessory may include at least one of the group: a peg, an exercise band, an upward limiter, a horizontal low pad, a high roll, an inclined pad, a vertical pad, a low roll, and a tall grip.

In another embodiment, the first attachment first portion includes at least one of an opening, a bar, and a pivot peg, and the first attachment second portion includes at least one of a peg, a hook, a self-locking hook assembly, and a self-locking spiral latch.

In another embodiment, the exercise assembly may further include a second opening passing through the second layer and exposing a second exposed portion of the first layer, a second attachment mechanism comprising a second attachment first portion configured with the first layer in an area of the second exposed portion, and a second attachment second portion adapted to be removably attached to the second attachment first portion, and a second accessory configured with the second attachment second portion of the second attachment mechanism.

In some embodiments, the first attachment first portion includes an opening, and the first attachment second portion includes a peg, and the second attachment first portion includes a bar and the second attachment second portion includes a hook.

In another embodiment, the exercise assembly may include a plurality of first openings passing through the second layer and exposing a plurality of first exposed portions of the first layer, and a plurality of first attachment mechanisms comprising a plurality of first attachment first portions configured with the first layer in areas of the plurality of first exposed portions.

In another embodiment, the plurality of first attachment first portions include at least one of an opening, a bar, and a pivot peg.

In another embodiment, the plurality of first openings are arranged in rows and columns.

In another embodiment, a plurality of second openings passing through the second layer and exposing a plurality of second exposed portions of the first layer, and a plurality of second attachment mechanisms comprising a plurality of second attachment first portions configured with the first layer in areas of the plurality of second exposed portions.

In another embodiment, the plurality of second attachment first portions include at least one of an opening, a bar, and a pivot peg.

In another embodiment, the plurality of first openings and the plurality of second openings are arranged in rows and columns.

In another embodiment, the first layer and the second layer overlap in areas adjacent the first opening.

In another embodiment, the first layer and the second layer overlap in areas adjacent the second opening.

In another embodiment, the first opening passes through at least a portion of the first layer.

In another embodiment, the platform is square, rectangular, circular or oval-shaped.

In another embodiment, the first accessory is adapted to extend above the top of the platform.

In another embodiment, the first accessory includes a peg adapted to extend above the top of the platform a distance of 6"-10".

According to another aspect, the present description includes an exercise assembly including a platform comprising a first layer and a second layer, a lower surface of the first layer defining a bottom of the platform and an upper surface of the second layer defining a top of the platform, a plurality of openings passing through the second layer and exposing a plurality of exposed portions of the first layer, a plurality of attachment mechanisms each comprising an attachment first portion configured with the first layer in an area of the plurality of exposed portions, and an attachment second portion adapted to be removably attached to a corresponding attachment first portion, and a plurality of accessories each configured with a corresponding attachment second portion. The plurality of accessories may include at least one of the group: a peg, an exercise band, an upward limiter, a horizontal low pad, a high roll, an inclined pad, a vertical pad, a low roll, and a tall grip.

In another embodiment, the attachment first portion includes at least one of an opening, a bar, and a pivot peg, and the attachment second portion includes at least one of a peg, a hook, a self-locking hook assembly, and a self-locking spiral latch.

In another embodiment, the plurality of openings are arranged in rows and columns.

In another embodiment, the opening passes through at least a portion of the first layer.

Other aspects and advantages of the invention will be apparent from the following description and the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

In general, the exercise platform and accessories system according to exemplary embodiments hereof includes a platform (e.g., a layered exercise mat) configured with a plurality of attachment mechanisms to which a variety of different exercise accessories may be attached. The user of the platform may choose which accessories to attach and the location of each attachment depending on the exercise and/or type of physical activity he/she may wish to perform. In this way, the system provides a fully configurable assembly adaptable to support a wide variety of physical activities.

In one example, the user of the system may attach a back rest, left and right leg support pegs, and left and right arm exercise bands to the platform. The user may then sit upon the platform and rest his/her back upon the back rest, position his/her legs against the leg support pegs, and perform arm exercises using the exercise bands. In this configuration, the system provides ergonomic support and stability to specific areas of the user's body while he/she performs the exercises. By supporting the user in the proper position, the system isolates the particular muscles being exercised while minimizing any stress to other parts of the user's body.

In a second example, the user may attach left and right side body support pegs and left and right leg exercise bands to the platform. The user may then recline upon the platform between the left and right side body support pegs and perform leg exercises using the exercise bands. The body support pegs hold the user's body in the correct position for the leg muscles to be safely isolated during the exercise while the platform supports the user's back.

It is understood that the above examples are meant for demonstration and that the platform system with associated accessories may be adapted to support a wide variety of different configurations for an assortment of physical activities. It also is understood that the scope of the system is not limited in any way by the configuration of the platform or by the accessories that may be utilized during its use.

In some embodiments, the platform may include a matrix of attachment mechanisms. In some embodiments the attachment mechanisms may be configured in rows and columns, in radial "spider" grids, in concentric circles, in other patterns or configurations and in any combinations thereof.

In some embodiments, the attachment mechanisms may include holes with associated posts, latches, bars, hooks, rings, brackets, clamps, threaded mechanisms, spring-loaded mechanisms, other types of attachment mechanisms and any combinations thereof.

In some embodiments, the accessories may include padded pegs, back supports, leg supports, arm supports, neck supports, body supports, cable pullies, exercise bands, straps, handles, horizontal pads, roll pads, inclined pads, vertical pads, upward limiters, towers, bridges, stands, other types of accessories and any combinations thereof.

Figure 1:
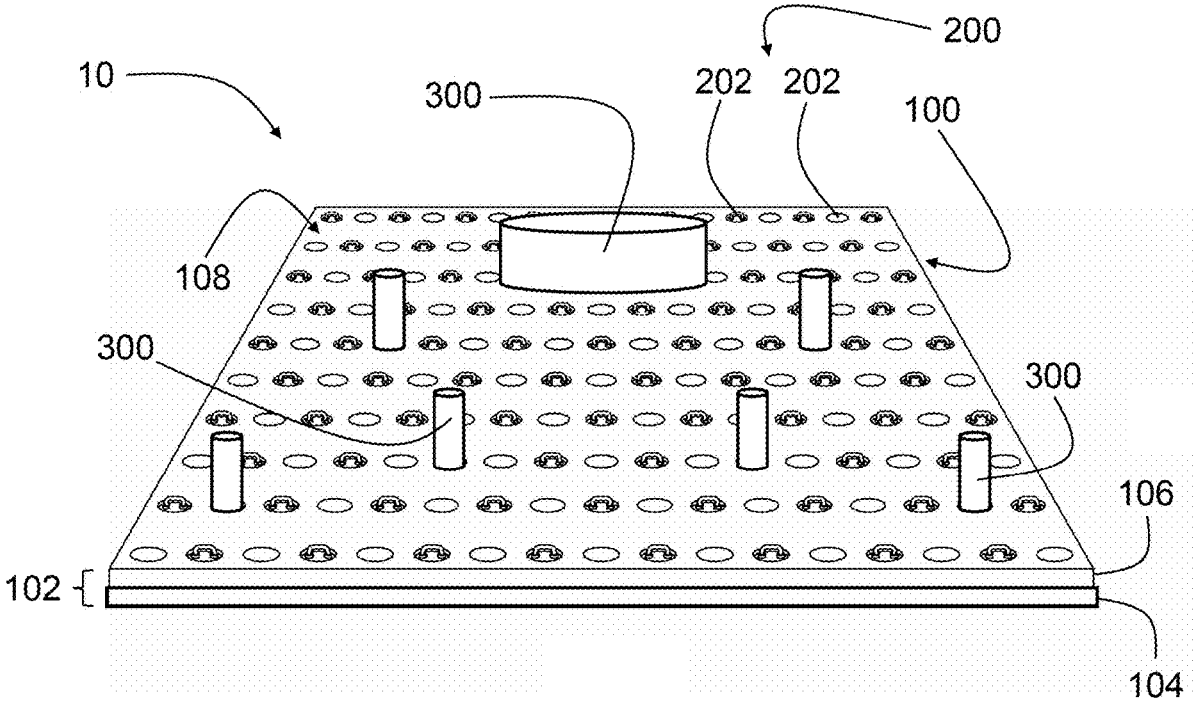
FIG. 1 shows aspects of an exercise platform and accessories system according to exemplary embodiments hereof.

In one exemplary embodiment hereof as shown in FIG. 1, the system 10 may include a base assembly 100, an attachment assembly 200 and hardware accessories 300. In general, the attachment assembly 200 includes attachment mechanisms 202 that facilitate the attachment of the hardware accessories 300 at different locations to the base assembly 100. The system 10 also may include other components and elements as necessary for the system 10 to perform its functionalities.

Base Assembly 100

In one exemplary embodiment hereof as shown in FIG. 1, the base assembly 100 includes a platform 102 with one or more layers. In one embodiment, the platform 102 includes a first layer 104 (e.g., a lower layer) and a second layer 106 (e.g., an upper layer). The first layer 104 may comprise a rigid, dense, solid, or otherwise generally strong material such as plastic, metal, wood, dense foam, a composite material, other types of dense materials and any combinations thereof. In this way, the first (bottom) layer 104 may provide support and stability to the platform 102. In addition, the attachment assembly 200 (and its associated attachment mechanisms 202 as will be described in other sections) may be attached to the bottom layer 104, and the bottom layer 104 being comprised of a dense and rigid material, may provide sufficient support to adequately anchor the attachment assembly 200.

The second layer 106 (e.g., the top layer) may comprise a compressible material such as foam, rubber, leather, other types of compressible materials and any combinations thereof. In this way, the second (top) layer 106 may be generally padded and may provide a comfortable top surface 108 on which the user may be positioned.

Figure 4:
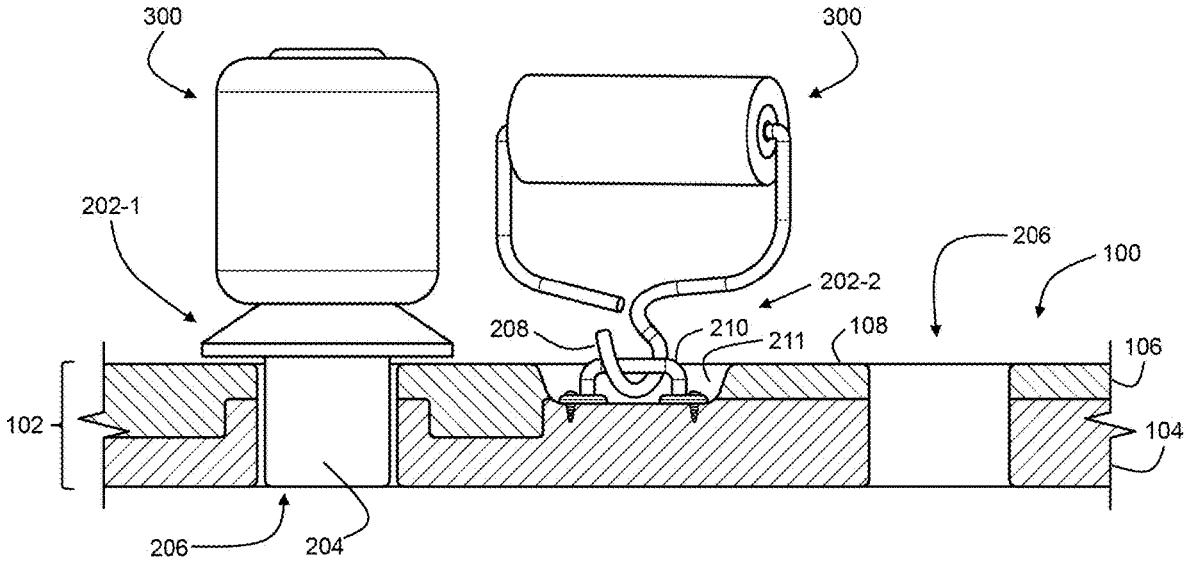
FIG. 4 shows aspects of attachment mechanisms according to exemplary embodiments hereof.
Figure 5:
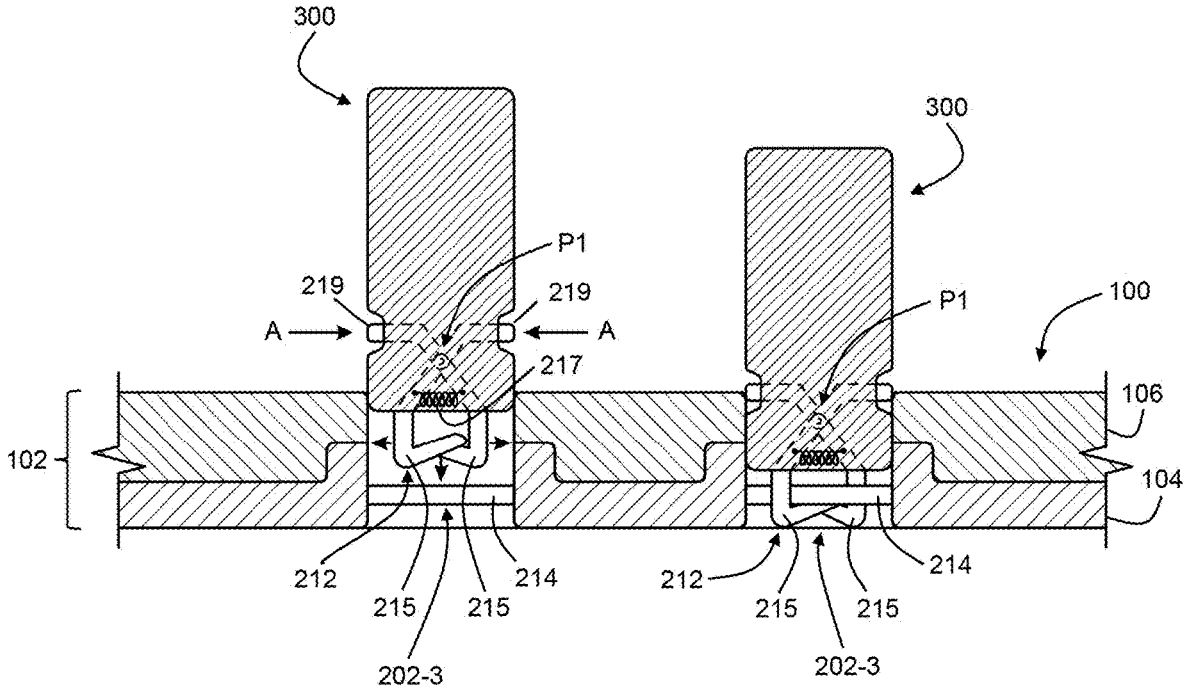
FIG. 5 shows aspects of attachment mechanisms according to exemplary embodiments hereof.
Figure 6:
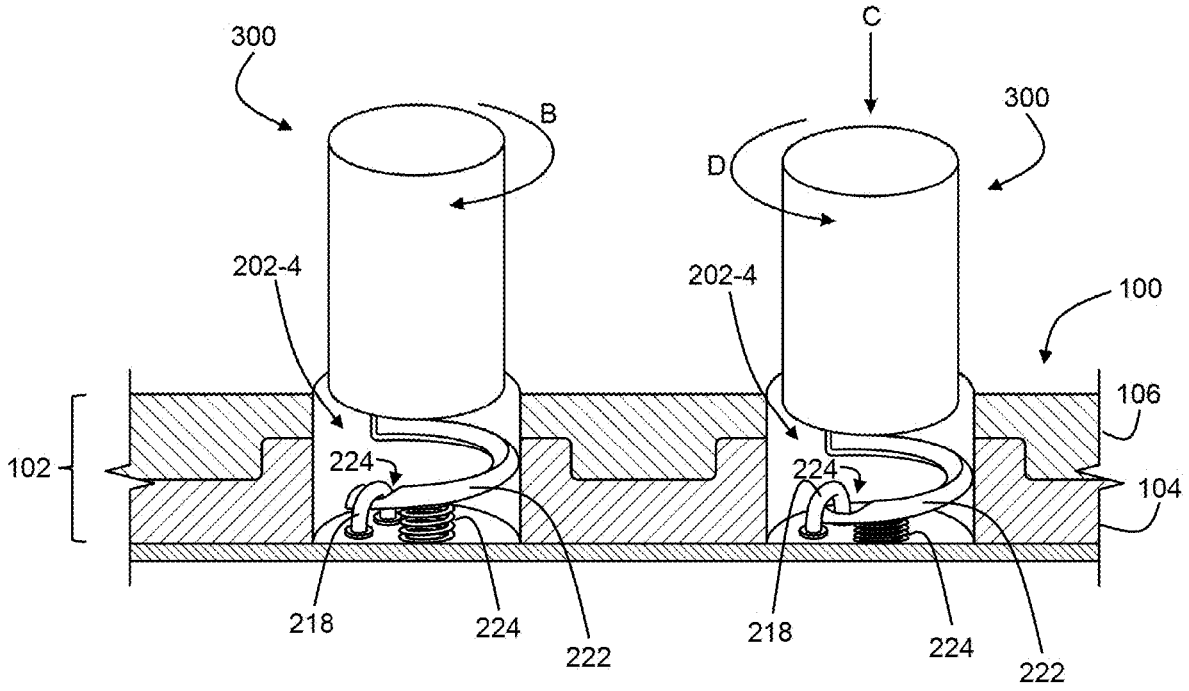
FIG. 6 shows aspects of attachment mechanisms according to exemplary embodiments hereof.

In some embodiments, the upper surface of the first layer 104 and the lower surface of the second layer 106 are generally flat and the respective flat surfaces are abutted together and bonded to form the platform 102. In other embodiments as shown in FIGS. 4-6, the first layer 104 may include an increased thickness in the areas adjacent the attachment mechanisms 202 to provide greater support to the mechanisms 202 in these areas.

In some embodiments, the first and second layers 104, 106 may be bonded together using adhesive, rivets, and/or any other suitable attachment techniques. The combined bottom layer 104 and top layer 106 may thereby provide a base assembly 100 with adequate density and rigidity to support the attachment assembly 200 and the associated accessories 300 (via the bottom layer 104), while providing a soft and cushioned upper surface (e.g., layer 106) onto which the user may be comfortably positioned to engage with the exercise system 10.

In some embodiments, the first and second layers 104, 106 may generally correspond with one another in size and shape so that a single second layer 106 may be configured on top of a single first layer 104 to form the platform 102. For example, the first and second layers 104, 106 may each be generally rectangular and may be combined to form a generally rectangular base assembly 100 (i.e., the footprint of the base assembly 100 is rectangular when viewed from above). The base assembly 100 also may be formed as other shapes such as circular, square, oval, triangular, trapezoidal, octagonal, other types of shapes or forms, and any combinations thereof. In some embodiments the overall size of the base assembly 100 may be about 4'-8' wide by about 4'-8' long, and preferably about 6' by 6'. In other embodiments, the base assembly 100 may be about 4'-8' in diameter (e.g., circular) and preferably about 6' in diameter. Other sizes also are contemplated.

Figure 2:
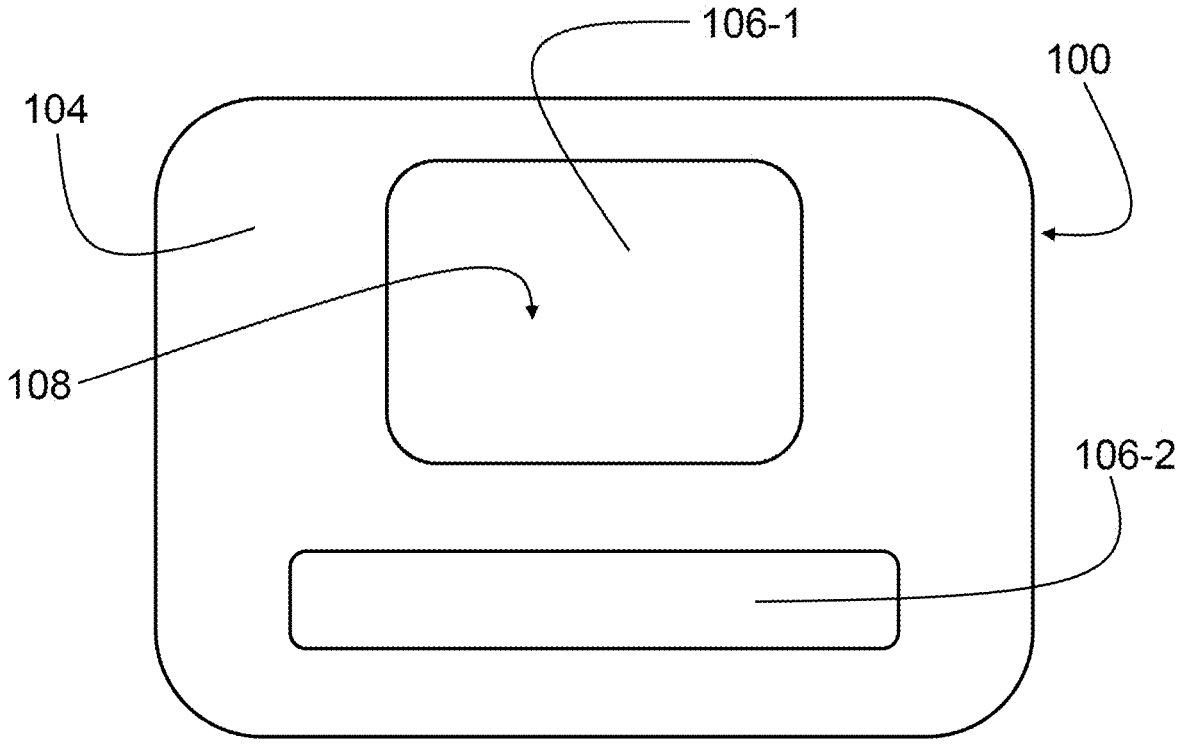
FIG. 2 shows aspects of a base assembly according to exemplary embodiments hereof.

In other embodiments as shown in FIG. 2, the first and second layers 104, 106 may not necessarily match in size and shape. For instance, the second layer 106 may be smaller than the first layer 104 and may not extend over areas of the first layer 104 not meant to support the user (e.g., the first layer 104 may include some areas only meant to support the attachment assembly 200 and/or the accessories 300). In another example, the second layer 106 may include several sections 106-1, 106-2, . . . **106-*n* (collectively and individually 106) configured with the first layer 104 in different areas meant to support the user (or multiple users) and not configured in areas of the first layer 104 meant only to support the attachment assembly 200 and/or the accessories 300. It is understood that in these cases, the shape of the first layer 104 and the shape of the second layer(s) 106** may be formed as any necessary shape and need not match.

In some embodiments, the first layer 104 and the second layer 106 may each be generally flat. In this way, the top surface of the base assembly 100 also may be generally flat. However, the first 104 and/or the second layer 106 also may include non-linear elements (e.g., internal support ridges or structures) as will be described in other sections.

In some embodiments as shown in FIG. 1, the base assembly 100 is adapted to rest upon a horizontal surface such as the floor. In other embodiments, the base assembly 100 is adapted to stand vertically (e.g., attached to the side of a wall), at an incline or in any other type of orientation. This will be described in other sections.

It is understood by a person of ordinary skill in the art that the above example architectures, shapes, and/or configurations of the first and second layers 104, 106 and of the resulting base assembly 100 are meant for demonstration and that the base assembly 100 may include other configurations of the first and second layers 104, 106 depending on its specific use. It also is understood that the scope of the system 10 is not limited in any way by the shapes and/or configurations of the first and second layers 104, 106.

In addition, the base assembly 100 may include additional layers in addition to the first and second layers 104, 106. For example, the base assembly 100 may include an additional layer below the first layer 104 that may provide a gripping texture for traction of the platform 100 to the floor. In another example, the base assembly 100 may include additional intermediary layers that may provide additional structural support to the base 100. In another example, the platform 100 may include additional top layers that may provide extra padding to certain areas of the top surface. It is understood that the base platform 100 may include any number of layers for any purpose and that the scope of the system 10 is not limited in any way by the number of layers that the base platform 100 may include.

In some embodiments the base assembly 100 may be designed (e.g., in size and shape) for a single user. In other embodiments the base assembly 100 may be designed (e.g., in size and shape) for multiple users (e.g., two users or more) in which case the size of the base assembly 100 may be larger.

Figure 3:
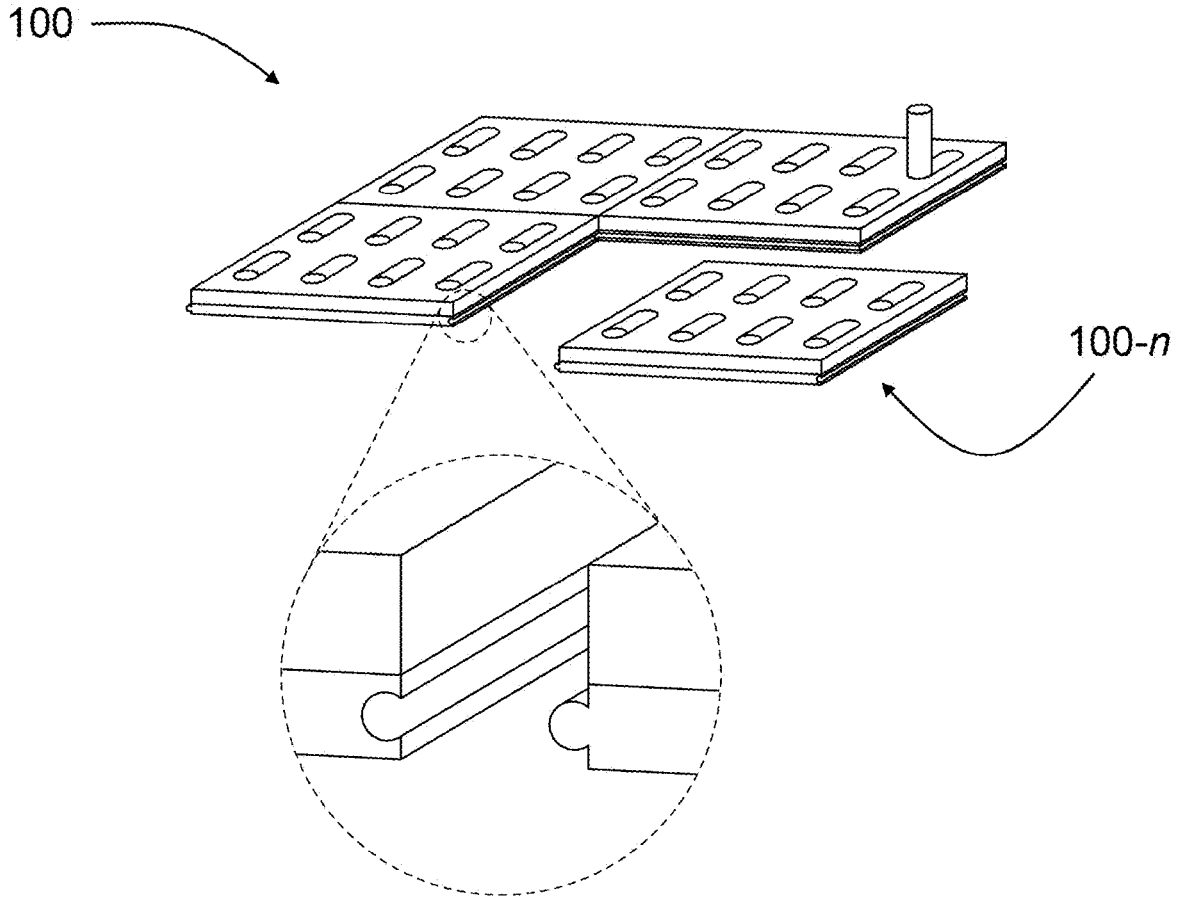
FIG. 3 shows aspects of a modular base assembly according to exemplary embodiments hereof.

In some embodiments as shown in FIG. 3, the base assembly 100 may be modular and may be formed of base assembly modules 100-1, 100-2, . . . **100-*n*. The base assembly modules 100-*n* may be attached together to form the overall base assembly 100 as desired. The base assembly modules 100-*n* may be connected together using slots and ridges as shown, or by using any other type of attachment techniques. In some embodiments, the modules 100-*n* may be connected to one another using hinges or other folding devices so that the modules 100-*n*** may be folded upon one another for storage while remaining connected.

While the base assembly modules **100-*n* are depicted as generally square in FIG. 3, it is understood that the modules 100-*n* may be formed as any shape, and that the shape of each module 100-*n* need not match the shape of any other module 100-*n*. It also is understood that any number of base assembly modules 100-*n* may be combined to form an overall base assembly 100 of any shape and/or size, and that the scope of the system 10 is not limited in any way by the numbers, shapes and/or sizes of any base assembly modules 100-*n*** that may be combined.

Attachment Assembly 200

In one exemplary embodiment hereof, the base assembly 100 may be configured with an attachment assembly 200. The attachment assembly 200 may include attachment mechanisms 202 that may be adapted to removably attach and secure the accessories 300 to the base assembly 100.

In some embodiments, the attachment assembly 200 may include one or more attachment mechanisms 202 configured with the base assembly 100. In some embodiments the attachment mechanisms may be configured in rows and columns (e.g., as a matrix), in radial "spider" grids, in concentric circles, randomly, in other patterns or configurations, and in any combinations thereof. The attachment mechanisms 202 may all be identical or may vary in type from one position to another. It also is not required that the patterns of attachment mechanisms 202 configured with the base assembly 100 be symmetrical although this may be preferred.

For example, as shown in FIG. 1, the attachment assembly 200 (configured with the base assembly 100) may include rows and columns of attachment mechanisms 202. In the example shown, each row may include a first type of attachment mechanism 202 followed by a second type of attachment mechanism 202, followed again by the first type, the second type and so on. However, it is understood that this example is merely one sample configuration and that the layout of attachment mechanisms 202 may include any types of attachment mechanisms 202 laid out in any type of configuration(s).

In some embodiments, the attachment mechanisms 202 may be spaced apart by about 6"-12" inches. However, other spacings may also be used and the spacings between any two or more attachment mechanisms 202 need not match.

In some exemplary embodiments hereof as shown in FIGS. 1 and 4-6, the attachment assembly 200 may include a plurality of different types of attachment mechanisms 202-1, 202-2, . . . **202-*n* (individually and collectively 202**).

Figure 7:
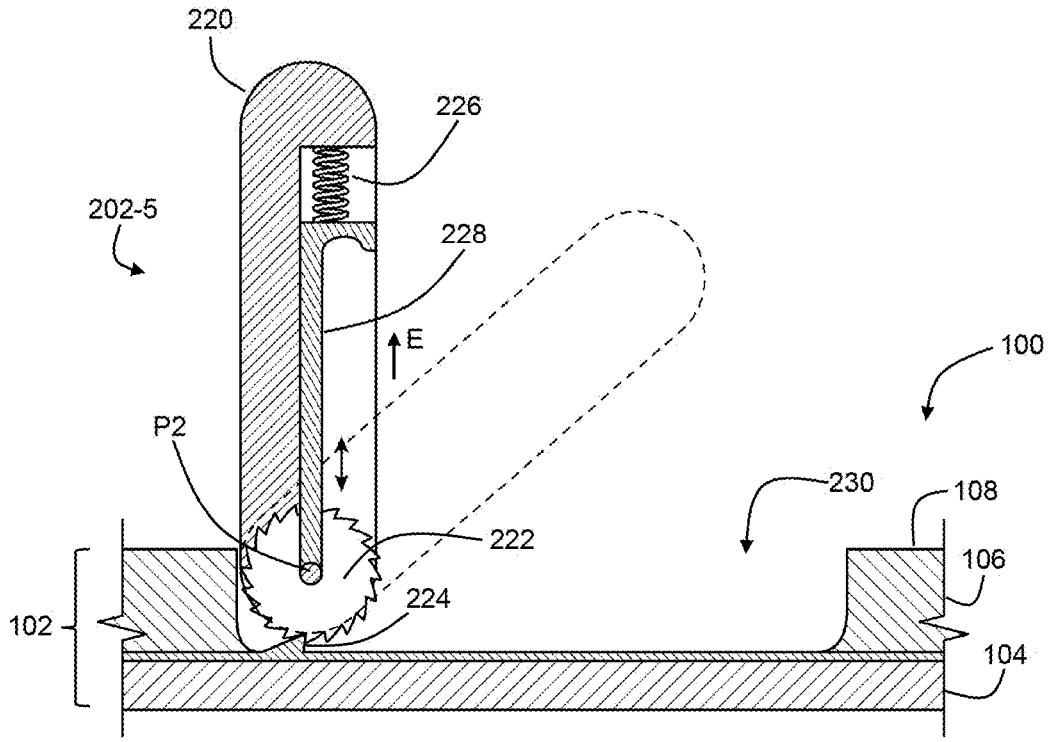
FIG. 7 shows aspects of attachment mechanisms according to exemplary embodiments hereof.
Figure 8:
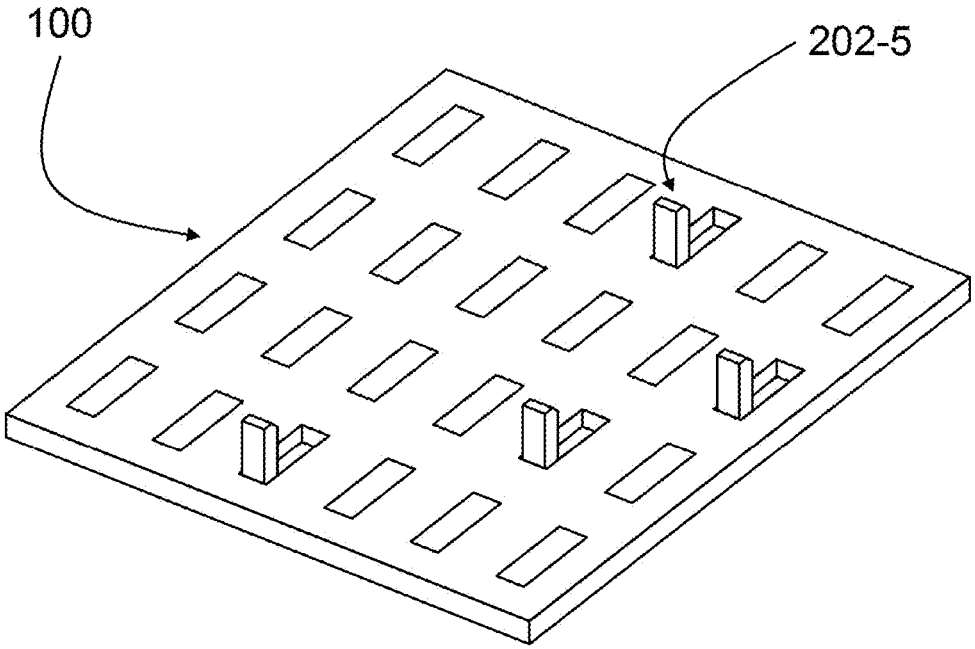
FIG. 8 shows aspects of attachment mechanisms according to exemplary embodiments hereof.

For example, in some embodiments, the attachment mechanisms 202 may include one or more of the following (without limitation):

1. Attachment mechanism 202-1 may include a peg 204 and an associated opening 206 into which the peg 204 may be received and secured. This is shown in FIG. 4.
2. Attachment mechanism 202-2 may include a hook 208 and a bar 210 upon which the hook 208 may be attached. This is shown in FIG. 4.
3. Attachment mechanism 202-3 may include a self-locking hook assembly 212 and a bar 214 upon which the self-locking hook assembly 212 may attach. This is shown in FIG. 5.
4. Attachment mechanism 202-4 may include a spiraling rod 222 and a bar 218 upon which the spiraling rod 222 may attach. This is shown in FIG. 6.
5. Attachment mechanism 202-5 may include a pivot peg 220 rotatably configured with the base assembly 100. This is shown in FIGS. 7-8.
6. Additional attachment mechanisms **202-*n*** may include latches, rings, brackets, clamps, threaded mechanisms, spring-loaded mechanisms, other types of attachment mechanisms and any combinations thereof.

In one embodiment as shown in FIG. 4, the attachment mechanism 202-1 includes a peg 204 and an associated opening 206 configured within the base assembly 100. The opening 206 may preferably extend through the top layer 106 and at least partially through (or entirely through) the lower layer 104. By passing at least partially into the lower layer 104, the opening 206 will provide adequate support to the peg 204 due to the rigidity of the lower layer 104. The circumferential shape of the peg 204 may preferably match that of the opening 206 (e.g., circular, square, octagonal or other shapes) such that the peg 204 may be received into the opening 206 and held securely therein. It is preferable that the peg 204 be held snug within the opening 206 so as to not become inadvertently dislodged during use, and that the peg 204 may subsequently be removed from the opening 206 when desired without requiring excessive force. In some embodiments, the peg 204 may be held within the opening 206 by pressure fit. In other embodiments, the peg 204 and/or the opening 206 may include detents, ridges, notches, or other elements that may further facilitate the securing of the peg 204 within an opening 206. While not shown, the peg 204 and opening 206 may include corresponding circumferential threads so that the peg 204 may be screwed into and out of the opening 206.

One or more pegs 204 may be configured with one or more accessories 300 and provided for use with one or more openings 206 configured in the base assembly 100. In this way, a user of the system 10 may configure any number of pegs 204 into any number of corresponding openings 206. As will be described in later sections, this architecture allows for the user to configure the accessories 300 onto the base assembly 100 in any pattern as required by different types of exercises. An example of this is shown in FIG. 1.

In one embodiment as shown in FIG. 4, the attachment mechanism 202-2 includes a hook 208 adapted to be configured with an accessory 300 and a bar 210 configured within the base assembly 100. As shown, the top layer 106 may include a cut-away area 211 that may expose a portion of the first layer 104. In this way, the bar 210 may be attached directly to the first layer 104, and the first layer 104, being rigid and sufficiently dense, may adequately support the attachment of the bar 210. As shown in FIG. 4, in some embodiments, the bar 210 may be an inverted U-shape with the bottom portions of the bar 210 attached to the first layer 104 (e.g., using screws or other attachment techniques). The bar 210 may also be formed as other shapes as necessary. In any event, it is preferable that the cut-away area 211 be deep enough to allow the top of the bar 210 to be recessed below the top surface 108 of the upper layer 106. In this way, the user may rest upon the top surface 108 without coming into contact with the bar 210.

In some embodiments, the hook 208 is adapted to hook around the bar 210 as shown in FIG. 4. In this way, an accessory 300 may be configured with a hook 208 and may subsequently be secured to the base assembly 100 via the hook 208 and bar 210 combination. It is understood that alternatively, a hook 208 may be configured with the base assembly 100 and a bar 210 may be configured with an accessory 300 to achieve a similar result.

One or more hooks 208 may be configured with one or more accessories 300 and provided for use with one or more bars 210 configured in the base assembly 100. In this way, a user of the system 10 may configure any number of hooks 208 onto any number of corresponding bars 210. As will be described in later sections, this architecture allows for the user to configure the accessories 300 onto the base assembly 100 in any pattern as required by different types of exercises. An example of this is shown in FIG. 1.

In one embodiment as shown in FIG. 5, the attachment mechanism 202-3 includes a self-locking hook assembly 212 configured with an accessory 300 and a bar 214 configured within the base assembly 100. As shown, the self-locking hook assembly 212 includes two interlocking hooks 215 cross-configured about a pivot point P1. A biasing mechanism 217 may be configured between the interlocking hooks 215 to bias the hooks 215 inward and in a generally locked position. To engage the attachment mechanism 202-3, the hooks 215 are pressed downward against the bar 214 from above such that the bar 214 may force the hooks 215 apart. In this way, with further downward motion, the hooks 215 may pass over the bar 214. Once past the bar 214, the bar 214 may release the hooks 215 and the biasing mechanism 217 may return the hooks 215 to a locked position around the bar 214. To release the hooks 215 from the bar 214, force may be applied to the upper tabs 219 in the direction of arrows A, and the hooks 215 may be forced open and released. It is understood that alternatively, a self-locking hook assembly 212 may be configured with the base assembly 100 and a bar 214 may be configured with an accessory 300 to achieve a similar result.

One or more interlocking hook assemblies 212 may be configured with one or more accessories 300 and provided for use with one or more bars 214 configured in the base assembly 100. In this way, a user of the system 10 may configure any number of interlocking hook assemblies 212 onto any number of corresponding bars 214. As will be described in later sections, this architecture allows for the user to configure the accessories 300 onto the base assembly 100 in any pattern as required by different types of exercises. An example of this is shown in FIG. 1.

In one embodiment as shown in FIG. 6, the attachment mechanism 202-4 includes a self-locking spiral latch configured with an accessory 300 and a bar 218 configured with the base assembly 100. As shown, the self-locking spiral latch includes a downward spiraling rod 222 configured with an end notch 224. The bar 218 may be an inverted U-shape with the bottom portions of the bar 218 attached to the first layer 104 (e.g., using screws or other attachment techniques). Other shaped bars 218 also may be used. The end notch 224 is adapted to engage the bar 218 when the downward spiraling rod 222 is rotated into position (e.g., in the direction of arrow B). Biasing mechanism 216 is adapted to apply an upward force to the spiraling rod 222 when the end notch 224 is engaged with the bar 218. In this way, the spiraling rod 222 is secured to the bar 218. To release the spiraling rod 222 from the bar 218, a downward force (in the direction of arrow C) is applied to the spiraling rod 222 to dislodge the end notch 224 from the bar 218, and the spiraling rod 222 is rotated outward (e.g., in the direction of the arrow D). It is understood that alternatively, a spiraling rod 222 may be configured with the base assembly 100 and a bar 218 may be configured with an accessory 300 to achieve a similar result.

One or more spiraling rods 222 may be configured with one or more accessories 300 and provided for use with one or more bars 218 configured in the base assembly 100. In this way, a user of the system 10 may configure any number of spiraling rods 222 onto any number of corresponding bars 218. As will be described in later sections, this architecture allows for the user to configure the accessories 300 onto the base assembly 100 in any pattern as required by different types of exercises. An example of this is shown in FIG. 1.

In one embodiment as shown in FIG. 7, the attachment mechanism 202-5 includes a pivot peg 220 rotatably configured with the base assembly 100. The pivot peg 220 may be configured about a pivot point P2 to rotate from an upper position (generally perpendicular to the base assembly 100) to a lower position (generally horizontal and flush with the top surface 108 of the top layer 106). The pivot point P2 may include a bar or axis configured with the bottom layer 104 (e.g., an inverted U-shaped bar) about which the pivot peg 220 may rotate. The pivot peg 220 includes a locking rachet 222, a locking tab 224, a biasing mechanism 226, and a lock release pull 228. As shown, the locking rachet 222 is biased downward by the biasing mechanism 226 (e.g., a spring) while engaging the locking tab 224. In this way, the pivot peg 220 may be set and locked at different angles with respect to the base assembly 100. The pivot peg 220 may be unlocked by moving the rachet 222 upward in the direction of arrow E (e.g., by pulling upward on the lock release pull 228). In some embodiments, the pivot peg 220 may include a locking mechanism configured with the lock release pull 228 (e.g., a slidable pin between the release pull 228 and a housing containing the elements of the peg 220) that may prevent inadvertent release of the pull 220 during use. The locking mechanism may be configured with a button to trigger its release.

In some embodiments, the pivot peg 220 includes a housing adapted to contain the peg's mechanical elements, and an outer padding adapted to surround the housing and provide comfort to the user of the assembly 10. The housing and/or the outer padding may include any cross-sectional shape such as, without limitation, square, rectangular, circular, oval shaped, trapezoidal, other shapes and any combinations thereof.

In some embodiments, the pivot peg 220 includes a hole in the top of the peg 220 to receive one or more accessories 300 for use with the assembly 10. In this way, when in an upright position, one or more accessories 300 may be attached to the peg 220. When not in use, the pivot peg 220 may be lowered into recess 230 (preferably flush with or recessed from the upper surface 108).

As shown in FIG. 8, one or more pivot pegs 220 may be provided and configured in the base assembly 100. In this way, a user of the system 10 may configure any number of pivot pegs 220 by rotating the desired pegs 220 upward. In this way, the pivot pegs 220 are made accessible to the accessories 300. As will be described in later sections, this architecture allows for the user to configure the accessories 300 onto the base assembly 100 in any pattern as required by different types of exercises.

It is understood by a person of ordinary skill in the art that the above attachment mechanism 202 examples are meant for demonstrational purposes and that the system 10 may include and/or utilize any type of attachment mechanisms 202. For example, the attachment mechanisms 202 may include other types of latches, rings, brackets, clamps, threaded mechanisms, spring-loaded mechanisms, other types of attachment mechanisms and any combinations thereof. It also is understood that the scope of the system 10 is not limited in any way by the type of attachment mechanisms 202 that the system 10 may include and/or utilize.

Accessories 300

In one exemplary embodiment hereof, the system 10 may include one or more hardware accessories 300 that may be attached to or otherwise configured with the base assembly 100 using one or more attachment mechanisms 202.

In some exemplary embodiments, the accessories 300 may include padded pegs, back supports, leg supports, arm supports, neck supports, cable pullies, exercise bands, straps, handles, horizontal pads, roll pads, inclined pads, vertical pads, upward limiters, towers, bridges, stands, other types of accessories and any combinations thereof. It is understood that the examples listed above are meant for demonstration and that the system 10 may include any type of accessory 300 as required. It also is understood that the scope of the system 10 is not limited in any way by the types of accessories 300 that it may include or that may be used with the system 10.

Figure 9:
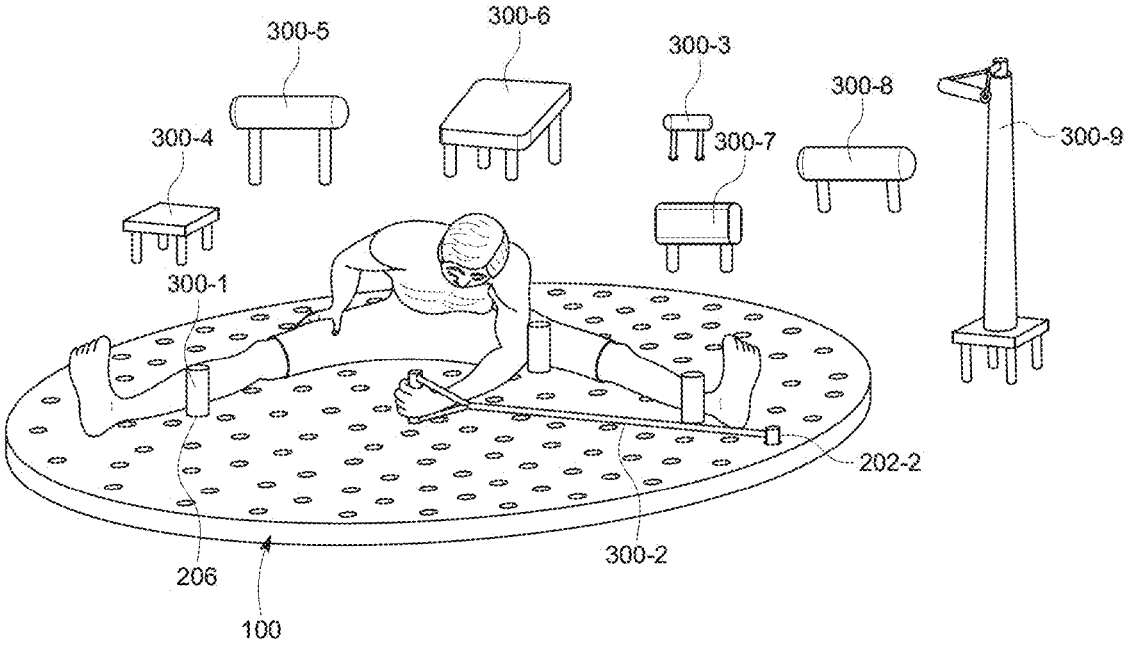
FIG. 9 shows aspects of an exercise platform and accessories system in use according to exemplary embodiments hereof.

In some exemplary embodiments as shown in FIG. 9, the accessories 300 may include a variety of different types of accessories 300-1, 300-2, . . . **300-*n* (individually and collectively 300**).

For example, in some embodiments, the accessories 300 may include one or more of the following devices (without limitation).

Accessory 300-1 may include an upright peg. In some embodiments, the upright peg 300-1 may be configured with an attachment peg 204 that may be received and secured within an opening 206. The peg 300-1 may attach to the attachment peg 204 as a concentric sheath or may be secured to the top of the attachment peg 204 using screws or adhesive, or by using other attachment methods. The peg 300-1 may preferably be somewhat rigid (e.g., comprising wood, metal or plastic) and may extend above the surface 108 an adequate distance (e.g., 6"-8") to support portions of the user's body while he/she is positioned on the base assembly 100. In some embodiments the peg 300-1 may include padding around its circumference. In some embodiments, the peg 300-1 may be used to limit involuntary movements of the user's body parts that are intended for isolation in the horizontal plane while using the system 10. It is understood that the peg 300-1 may be configured with any other types of attachment 202.

Accessory 300-2 may include an exercise band. One end of the exercise band 300-2 may be configured with an attachment mechanism 202 and the other end of the exercise band 300-2 may be configured with a handle. In this way, the exercise band 300-2 may be configured with the base assembly 100 for use. The exercise band 300-2 may comprise an elastic material (e.g., rubber) and may provide tension during its use as is known in the art.

Accessory 300-3 may include an upward limiter. The upward limiter 300-3 may include two or more feet, each configured with an attachment mechanism 202 so that the limiter 300-3 may be configured with the base assembly 100. The limiter 300-3 also may include a generally horizontal support structure (preferably padded) extending between its feet. In this way, a user may place his/her foot under the limiter 300-3 to be held in place during exercises (e.g., sit-ups).

Accessory 300-4 may include a horizontal low pad. The horizontal pad 300-4 may include one or more feet, each configured with an attachment mechanism 202 so that the pad 300-4 may be configured with the base assembly 100. When configured with the base 100, the horizontal low pad 300-4 may provide additional padding to the top of the base 100.

Accessory 300-5 may include a high roll. The high roll 300-5 may include one or more feet, each configured with an attachment mechanism 202 so that the high roll 300-5 may be configured with the base assembly 100. The high roll 300-5 also may include a support structure, such as a padded cylinder, extending between its feet. When configured with the base 100, the high roll 300-5 may provide a horizontal rolling pad above the top surface of the base 100.

Accessory 300-6 may include an inclined pad. The inclined pad 300-6 may include one or more feet, each configured with an attachment mechanism 202 so that the pad 300-6 may be configured with the base assembly 100. The inclined pad 300-6 may provide inclined padding that the user may rest a portion of his/her body against during use.

Accessory 300-7 may include a vertical pad. The vertical pad 300-7 may include one or more feet, each configured with an attachment mechanism 202 so that the pad 300-7 may be configured with the base assembly 100. The vertical pad 300-7 may provide vertical padding that the user may rest a portion of his/her body against during use.

Accessory 300-8 may include a low roll. The low roll 300-8 may include one or more feet, each configured with an attachment mechanism 202 so that the low roll 300-8 may be configured with the base assembly 100. The low roll 300-8 also may include a support structure, such as a padded cylinder, extending between its feet. When configured with the base 100, the low roll 300-8 may provide a horizontal rolling pad above the top surface of the base 100. In some embodiments, the low roll 300-8 may extend above the top surface of the base 100 a lesser distance compared to the high roll 300-5.

Accessory 300-9 may include a tall grip. The tall grip 300-9 may include one or more feet, each configured with an attachment mechanism 202 so that the tall grip 300-9 may be configured with the base assembly 100. The tall grip 300-9 may include a tower or other type of stand that may extend above the top of the base assembly 100 a distance sufficient for associated exercises. In some embodiments, the upper end of the tall grip 300-9 may be configured to receive and support other devices such as handles, exercise bands, and other types of devices for use with exercising.

Additional accessories **300-*n*** may include other types of accessories such as a vertical back support, blocks to assist in moving various body parts during stretching exercises, and any combination thereof.

Any of the accessories 300 may be configured with the base assembly 100 by utilizing any type of attachment mechanism(s) 202 as required by the type of specific accessory 300 and its intended functionalities.

In some embodiments, the accessories 300 may include various designs, surfaces, and angles for limiting body motions in the horizontal plane, the vertical plane, angular planes and any combination thereof. In some embodiments, the accessories 300 may limit upward, forward, backward and/or downward movements, may move or lift body parts, anchor pivoting body parts or be used for different purposes.

FIG. 9 depicts a user using the system 10 while in a sitting position. Pegs 300-1 are configured within openings 206 and used as motion limiters for the user's left and right legs. The user is depicted as also using an exercise band 300-2 configured with the base assembly 100 via an attachment mechanism 202-2 (a hook 208 and bar 210).

Figure 10:
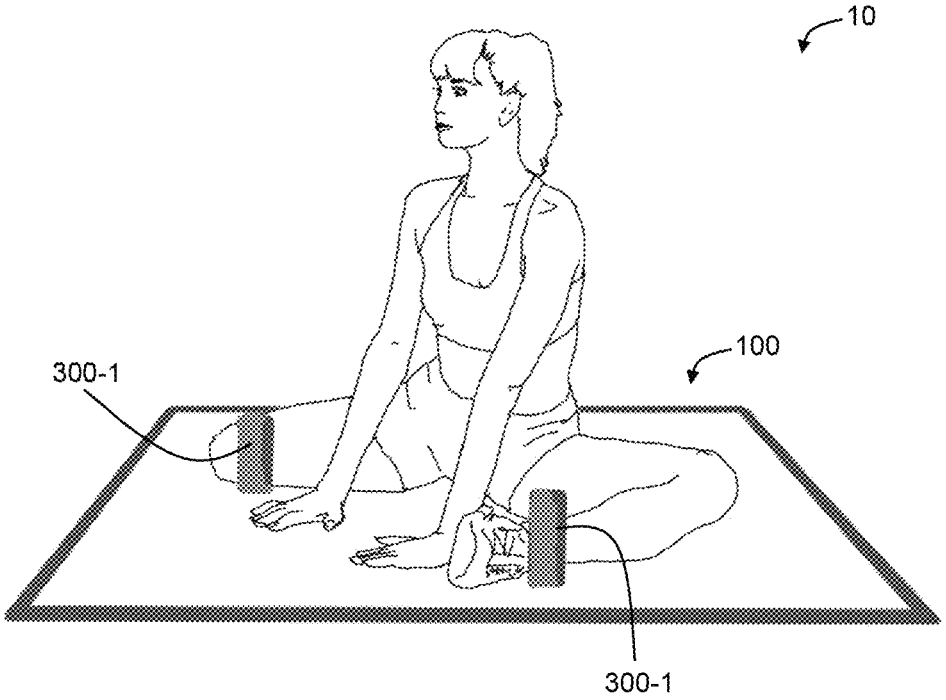
FIG. 10 shows aspects of an exercise platform and accessories system in use according to exemplary embodiments hereof.

FIG. 10 depicts a user using the system 10 while in a sitting position. Pegs 300-1 are configured with the base assembly 100 and used as motion limiters for the user's left and right legs.

Figure 11:
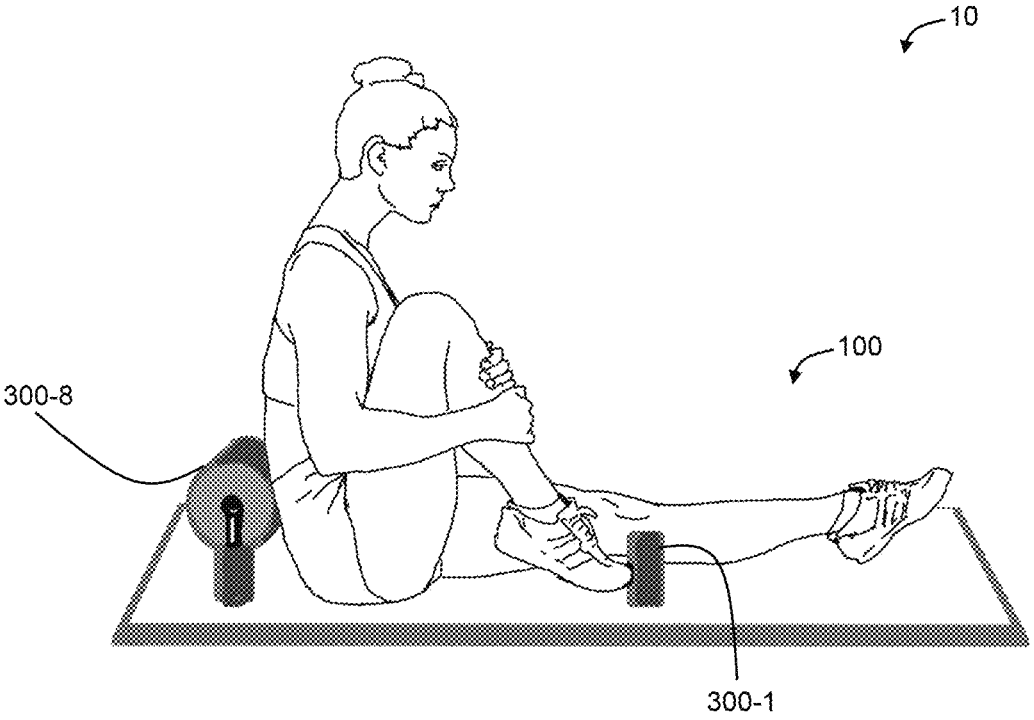
FIG. 11 shows aspects of an exercise platform and accessories system in use according to exemplary embodiments hereof.

FIG. 11 depicts a user using the system 10 while in a sitting position. Peg 300-1 is configured with the base assembly 100 and used as motion limiters for the user's left leg and a low roll 300-8 is configured to provide back support to the user.

Figure 12:
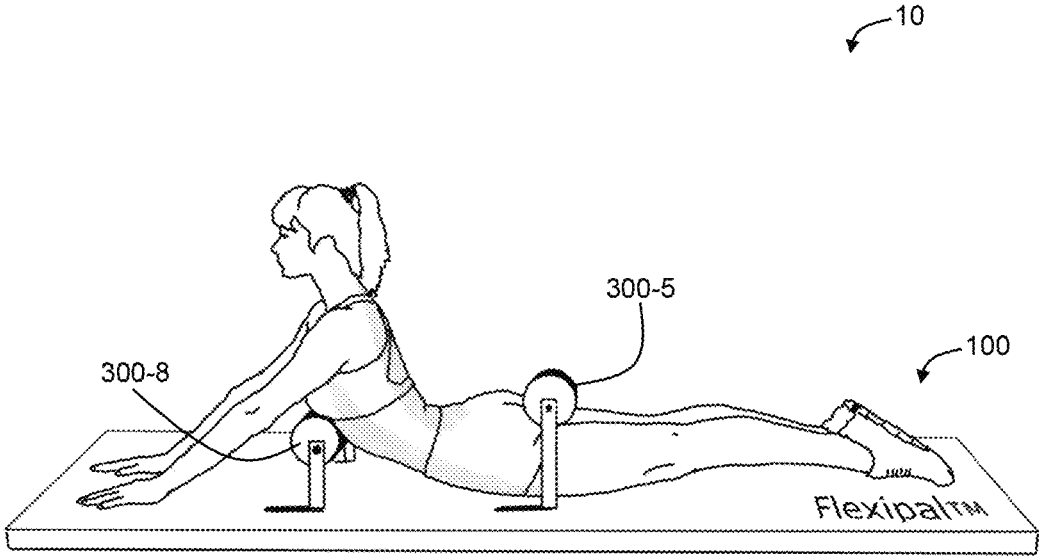
FIG. 12 shows aspects of an exercise platform and accessories system in use according to exemplary embodiments hereof.

FIG. 12 depicts a user using the system 10 while in a prone position. Low roll 300-8 is configured with the base assembly 100 and used to support the user's chest while high roll 300-5 is configured as a motion limiter for the user's buttocks.

Figure 13:
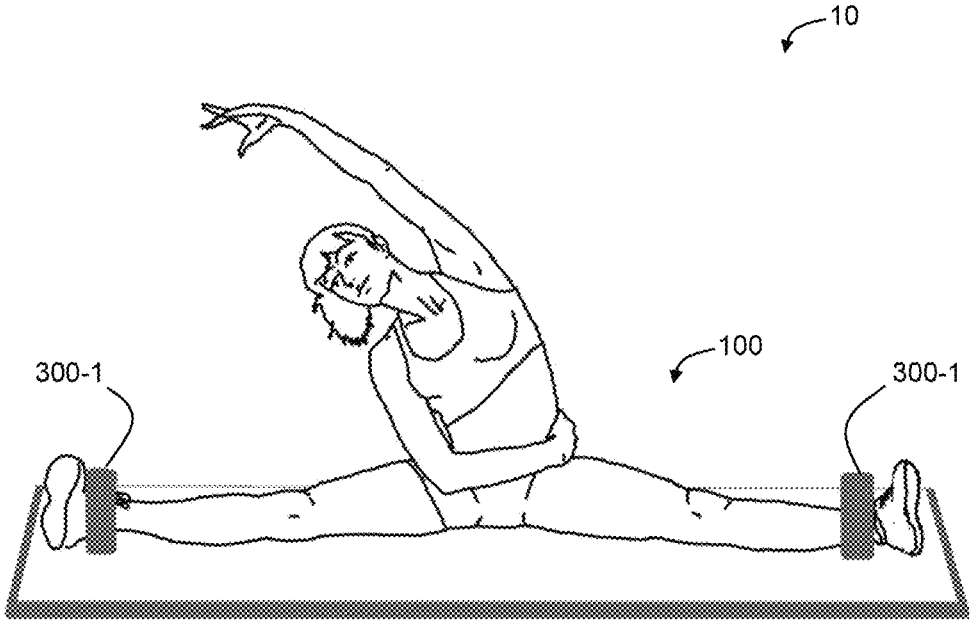
FIG. 13 shows aspects of an exercise platform and accessories system in use according to exemplary embodiments hereof.

FIG. 13 depicts a user using the system 10 while in a sitting position. Pegs 300-1 are configured with the base assembly 100 and used as motion limiters for the user's left and right legs.

Figure 14:
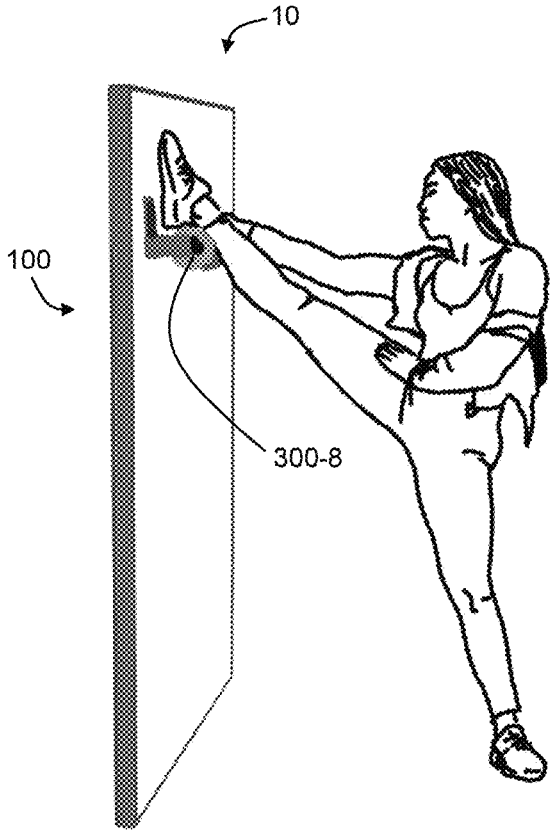
FIG. 14 shows aspects of an exercise platform and accessories system in use according to exemplary embodiments hereof.

FIG. 14 depicts a user using the system 10 while in a standing position. The base assembly 100 is oriented vertically (e.g., attached to a side of a wall) and a high roller

300-5 is configured with the base assembly 100 and used as motion support for the user's right leg.

It is understood that the depiction of use shown in FIGS. 9-13 are meant for demonstration and that a user may use the system 10 in any way as appropriate. It is also understood that the scope of the system 10 is not limited in any way by the way in which a user may use the system 10.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims

The invention claimed is:

1. An exercise assembly comprising:

a platform comprising a first layer and a second layer, a lower surface of the first layer defining a bottom of the platform and an upper surface of the second layer defining a top of the platform;

a first opening passing through the second layer and exposing a first exposed portion of the first layer;

a first pivot point configured with the first layer in an area of the first exposed portion; and a first pivot peg including a first end and a second end defining a first longitudinal axis, the first end pivotably configured with the first pivot point, the first pivot peg adapted to rotate about the first pivot point from a first position to a second position;

wherein the first longitudinal axis is substantially parallel to the platform in the first position and substantially perpendicular to the platform in the second position.

2. The exercise assembly of claim 1 further comprising a first accessory adapted to be removably coupled to the first pivot peg, the first accessory including at least one of the group: a peg, an exercise band, an upward limiter, a horizontal low pad, a high roll, an inclined pad, a vertical pad, a low roll, and a tall grip.

3. The exercise assembly of claim 2 wherein the first accessory includes a peg adapted to extend above the top of the platform a distance of 6"-12".

4. The exercise assembly of claim 1 further comprising:

a second opening passing through the second layer and exposing a second exposed portion of the first layer;

a second pivot point configured with the first layer in an area of the second exposed portion; and a second pivot peg including a third end and a fourth end defining a second longitudinal axis, the third end pivotably configured with the second pivot point, the second pivot peg adapted to rotate about the second pivot point from a third position to a fourth position;

wherein the second longitudinal axis is substantially parallel to the platform in the third position and substantially perpendicular to the platform in the fourth position.

5. The exercise assembly of claim 1, further comprising a first ratchet configured with the first end of the first pivot peg and a first locking tab configured with the first layer, the first locking tab adapted to engage the first rachet.

6. The exercise assembly of claim 5, further comprising a first release pull adapted to disengage the first ratchet from the first locking tab.

7. The exercise assembly of claim 6, further comprising a biasing mechanism adapted to provide a bias to the first release pull.

8. An exercise assembly comprising:

a platform comprising a first layer and a second layer, a lower surface of the first layer defining a bottom of the platform and an upper surface of the second layer defining a top of the platform;

a plurality of openings passing through the second layer and respectively exposing a plurality of exposed portions of the first layer;

a plurality of pivot points configured with the first layer in areas of the plurality of exposed portions, respectively;

a plurality of pivot pegs each including a first end and a second end defining a respective longitudinal axis of each pivot peg, the first end of each pivot peg configured with a respective pivot point, each pivot peg adapted to rotate about its respective pivot point from a first position to a second position;

wherein each respective longitudinal axis is substantially parallel to the platform in the first position and substantially perpendicular to the platform in the second position.

9. The exercise assembly of claim 8 further comprising at least one accessory adapted to be removably coupled to at least one of the plurality of pivot pegs and including at least one of the group: a peg, an exercise band, an upward limiter, a horizontal low pad, a high roll, an inclined pad, a vertical pad, a low roll, and a tall grip.

10. The exercise assembly of claim 8 wherein the plurality of openings are arranged in rows and columns.

11. The exercise assembly of claim 8, wherein at least one of the plurality of pivot pegs includes a ratchet configured with the first end of the at least one of the plurality of pivot pegs, and wherein the first layer includes a locking tab adapted to engage the ratchet.

12. The exercise assembly of claim 11, further comprising a release pull adapted to disengage the ratchet from the locking tab.

13. The exercise assembly of claim 12, further comprising a biasing mechanism adapted to provide a bias to the release pull.

* * * * *